US011844444B2

(12) United States Patent
Rosburg et al.

(10) Patent No.: US 11,844,444 B2
(45) Date of Patent: Dec. 19, 2023

(54) SELF-SERVE KIOSK

(71) Applicant: PepsiCo, Inc., Purchase, NY (US)

(72) Inventors: Klaus Rosburg, Brooklyn, NY (US); Gustavo De Souza Messias, Milan (IT); Ali Akay, Milan (IT)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 17/456,494

(22) Filed: Nov. 24, 2021

(65) Prior Publication Data

US 2023/0157462 A1 May 25, 2023

(51) Int. Cl.

| | |
|---|---|
| ***A47F 3/04*** | (2006.01) |
| ***G07C 9/00*** | (2020.01) |
| ***A47F 3/00*** | (2006.01) |
| ***A47F 11/10*** | (2006.01) |
| ***E05B 1/00*** | (2006.01) |

(52) U.S. Cl.

CPC ..... *A47F 3/0478* (2013.01); *A47F 3/001* (2013.01); *A47F 3/043* (2013.01); *A47F 3/0434* (2013.01); *A47F 11/10* (2013.01); *G07C 9/00658* (2013.01); *E05B 1/0015* (2013.01)

(58) Field of Classification Search

CPC ..... A47F 3/001; A47F 3/002; A47F 3/0426; A47F 3/043; A47F 3/0478; A47F 11/10; F25D 23/028; F25D 27/00; F25D 27/005; F25D 29/00; F25D 29/005; F25D 2323/02; F25D 2400/36; F25D 2400/361

See application file for complete search history.

(56) References Cited

U.S. PATENT DOCUMENTS

| | | | | |
|---|---|---|---|---|
| 2011/0152024 | A1* | 6/2011 | Kuehl | F25D 23/00 474/166 |
| 2016/0186984 | A1* | 6/2016 | Giacomini | F24C 15/024 362/85 |
| 2017/0011384 | A1* | 1/2017 | Tkachenko | G06Q 30/0237 |
| 2019/0383550 | A1* | 12/2019 | Miedema | F25D 23/028 |
| 2021/0256791 | A1* | 8/2021 | Friend | G07F 9/105 |

FOREIGN PATENT DOCUMENTS

| | | | | |
|---|---|---|---|---|
| DE | 102008041519 | A1 * | 3/2010 | F24C 15/024 |
| DE | 102015003337 | A1 * | 9/2016 | D06F 34/28 |
| WO | WO-2016110479 | A1 * | 7/2016 | F25D 23/028 |

* cited by examiner

*Primary Examiner* — Andrew M Roersma

(74) *Attorney, Agent, or Firm* — Sterne, Kessler, Goldstein & Fox P.L.L.C.

(57) ABSTRACT

Aspects of the present disclosure include a self-serve kiosk with a door that allows access to products inside the kiosk. A bar is disposed on the door and contains a user interface that allows the user to purchase products. The bar also includes a handle that the user can grasp to open and close the door. The bar can rotate with respect to the door into an access position that improves maintenance access to the user interface and related components. In aspects, the bar and related components improve integration of self-serve functionality into existing product storage devices.

17 Claims, 5 Drawing Sheets

SELF-SERVE KIOSK

FIELD

This disclosure relates to self-serve kiosks. Specifically, this disclosure relates to a mounting system for a controller and handle for a self-serve kiosk.

BACKGROUND

Products may be offered to consumers from, for example, self-serve kiosks. Self-serve kiosks are able to act as a point-of-sale for products without the need for a salesperson present. In one example, a self-serve kiosk can automatically detect products removed by users and can automatically charge users for removed products. For example, users can unlock the self-serve kiosks by inputting payment information (e.g., by swiping a credit card) into a controller of the self-serve kiosks. Upon receipt of the payment information, the controller can unlock a door of the self-serve kiosks to provide access to products secured within the self-serve kiosks. Users can select whichever products they like and sensors of the self-serve kiosks can automatically detect the products selected by the user. The controller can process data from the sensors to identify the selected products and can display the selected products to the user to verify their purchases. The controller can use the inputted payment information to automatically charge the user for selected products taken from the self-serve kiosks. The self-serve kiosks can also detect when users return products back to the self-serve kiosks and not charge and/or credit users for returned products. Other examples of self-serve kiosks do not include separate sensors that detect the products but rely on the user to identify the product or products they are purchasing, for example, by scanning each product after removing it from the self-serve kiosk.

While self-serve kiosks provide easy and convenient purchase opportunities for users, integration of components of the self-serve kiosk such as the user interface, the payment interface, and the controller into the self-serve kiosks can be problematic. For example, there exists a need for integration of at least some of these components into self-serve kiosks that is both easily accessible to users for product purchases and to technicians for installation and/or servicing of the controller. There also exists a need for integration of these components into existing structures (e.g., coolers) without significant modification to the existing structures to leverage existing kiosk designs and reduce costs.

BRIEF SUMMARY

Some aspects of the present disclosure includes a product cooler for storing products for sale, the product cooler having a housing including a door that is configured to provide access to an interior of the housing; a lock that is configured to lock the door to restrict access to the interior of the housing; a bar comprising a base member and an end members disposed at an end of the base member and pivotally connected to an exterior of the door such that the bar can rotate with respect to the door; a controller configured to lock and unlock the lock; and a user interface mounted to the bar.

Some aspects described herein relate to a self-serve kiosk that includes a housing comprising a door that is configured to provide access to an interior of the housing; a lock that is configured to lock the door to restrict access to the interior of the housing; a bar that is movably connected to the door; and a controller configured to lock and unlock the lock.

Other aspects described herein relate to a self-serve kiosk that includes a housing comprising a door that is configured to provide access to an interior of the housing; shelves disposed in the interior of the housing configured to receive products to be dispensed; a lock that is configured to lock the door to restrict access to the interior of the housing; a bar that is movably connected to the door; a handle disposed on the bar and configured to be grasped by a user; and a controller configured to lock and unlock the lock. Movement of the bar is configured to allow access to the controller for maintenance.

BRIEF DESCRIPTION OF THE DRAWINGS

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
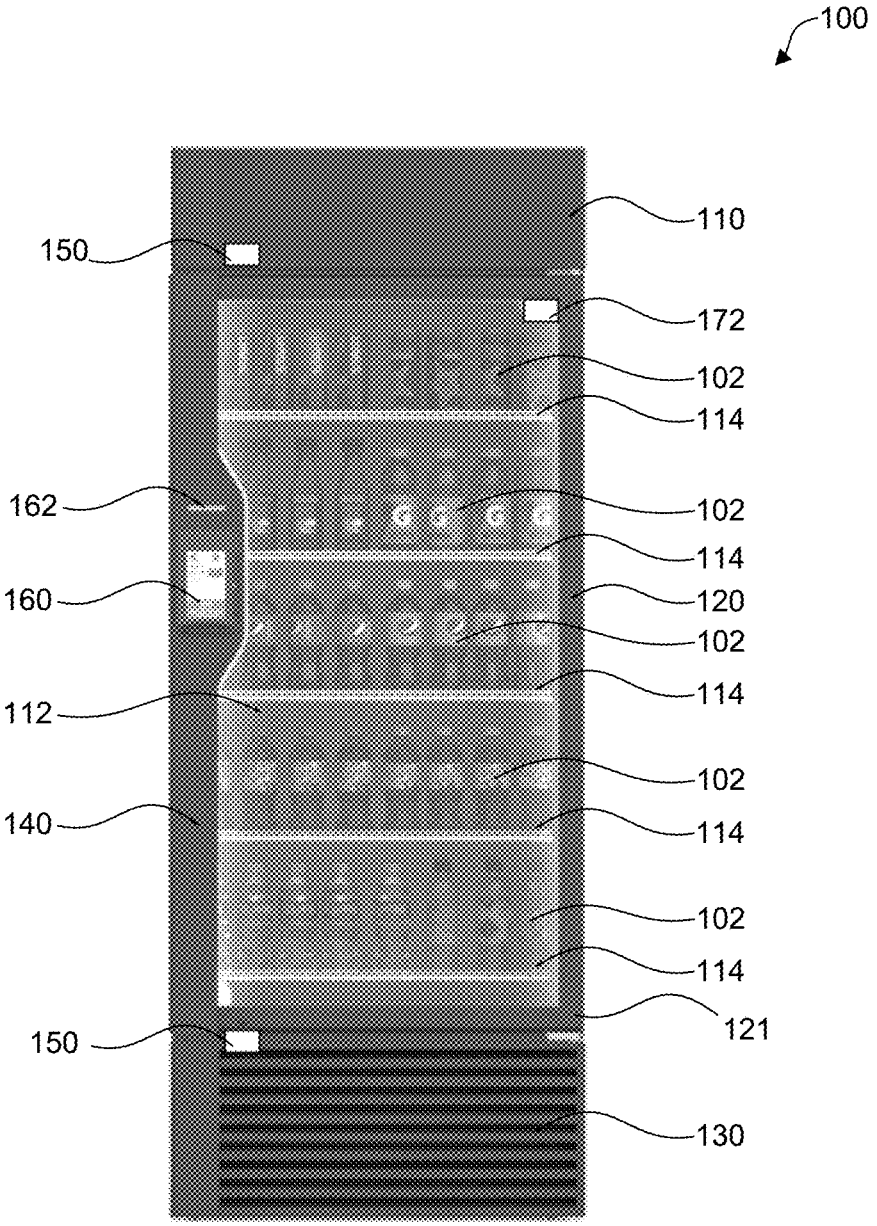
FIG. 1 is a front view of a self-serve kiosk according to aspects of the present disclosure.

Reference will now be made in detail to representative aspects illustrated in the accompanying drawings. References to "one aspect," "an aspect," "an exemplary aspect," etc., indicate that the aspect described may include a particular feature, structure, or characteristic, but every aspect may not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspect whether or not explicitly described.

Self-serve kiosks provide easy and convenient purchase opportunities for users. Self-service kiosk owners also benefit from increased product sales without the need to provide additional staffing at the point of sale. However, integration of the user interface and controller components into the self-serve kiosks can be problematic. For example, there exists a need for integration of these components into self-serve kiosks that is both easily accessible to users for product purchases and to technicians for installation and/or servicing of the controller. There also exists a need for integration of these components into existing structures (e.g., coolers) without significant modification to the existing structures to leverage existing kiosk designs and reduce costs. This is especially relevant for integrating these components into existing coolers and because user interfaces are typically integrated into the housing to the side of the cooler door. However, existing cooler housings are usually the same or nearly the same width as the cooler door, which means that the housing would need to be extended outwards to incorporate the user interface in the typical fashion. This is undesirable because it requires substantial modification of the cooler housing and increases the footprint of the cooler.

Aspects of the present disclosure include a product cooler for storing products for sale, the product cooler having a housing including a door that is configured to provide access to an interior of the housing; a lock that is configured to lock the door to restrict access to the interior of the housing; a bar comprising a base member and an end members disposed at an end of the base member and pivotally connected to an exterior of the door such that the bar can rotate with respect to the door; a controller disposed on the bar and configured to lock and unlock the lock; and a user interface mounted to the bar.

These and other aspects of this disclosure disclose a single, multi-function bar 140 that is easily integrated onto doors of existing product coolers 100. Bar 140 can replace an existing exterior handle and can include a handle 148 that users can grasp to open and close a door 120 of a housing 110 of the cooler 100. Bar 140 also contains components needed to implement a self-serve functionality in the product cooler. In some aspects, with the exception of certain sensors that need to be included in an interior 112 of housing 110, bar 140 includes the necessary controllers and user interfaces that allows for conversion of the existing product cooler to a self-service kiosk 100. In aspects, bar 140 mounts only to the exterior of door 120, and thus requires minimal additional structure changes to housing 110. Further, bar 140 is able to pivot with respect to door 120, which allows improved maintenance and installation access to any components mounted to bar 140, while also preventing unauthorized access to these components when bar 140 is pivoted back into its normal operating position.

Some advantages of this and other aspects discussed here include a solution for integrating components such as user interfaces and controllers into self-service kiosks that allows easy user access to products for purchase and also improves installation and maintenance access to these components. Other advantages include improved integration into existing structures without needing extensive structural modifications.

Figure 7:
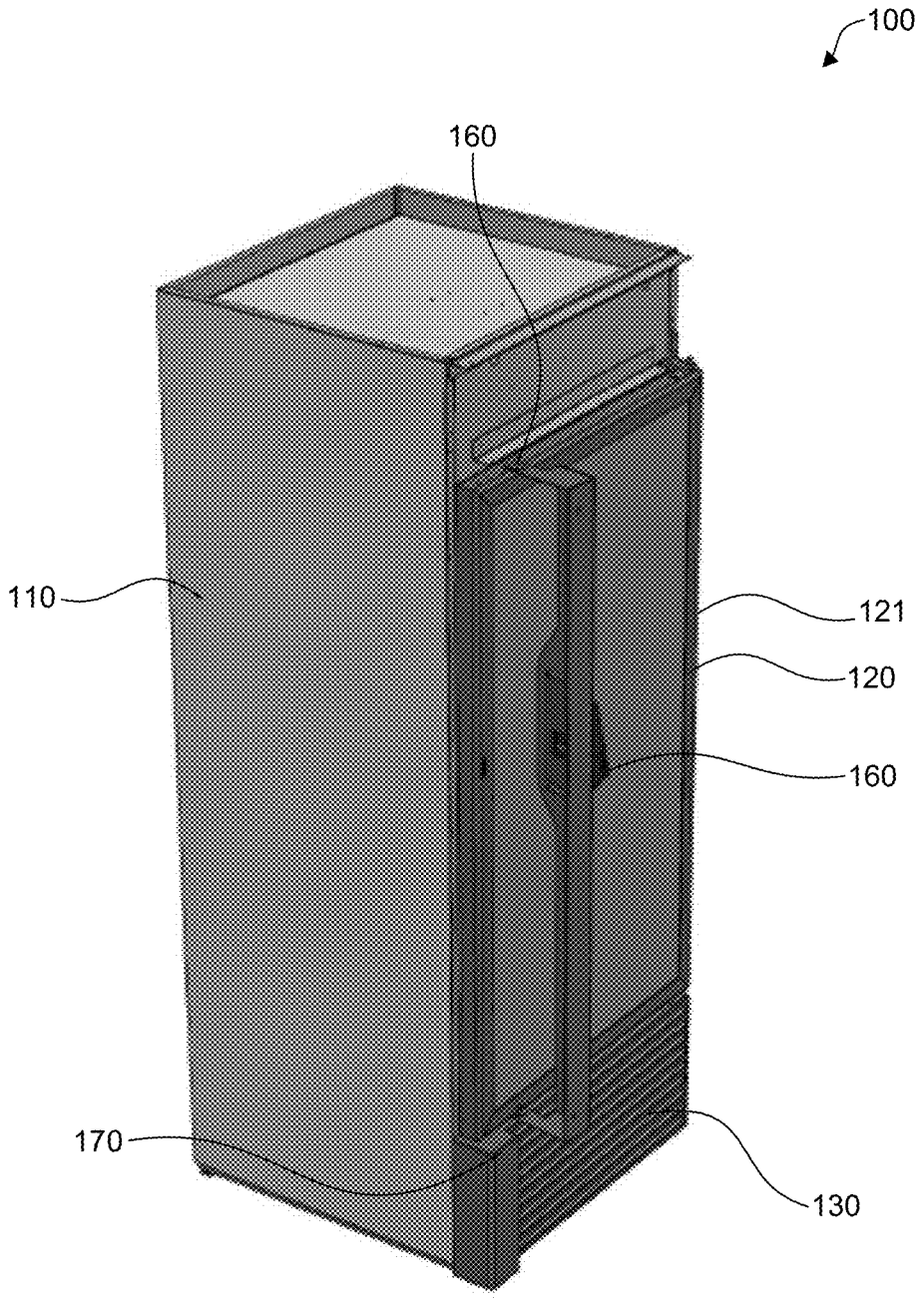
FIG. 7 is a perspective view of a self-serve kiosk according to aspects of the present disclosure.

As shown in FIGS. 1-3 and 7, an aspect of a self-service kiosk 100 has a housing 110. Housing 110 defines an interior 112 that contains products 102 for purchase. In the aspect shown in FIG. 1, products 102 are arranged on shelves 114 that are disposed in interior 112 of housing 110. Housing 110 can be formed in any suitable shape. For example, as shown in FIGS. 1 and 7, in aspects housing 110 can be formed as a rectangular prism. In other aspects, housing 110 can be formed as a cylinder or other prismatic shapes. Housing 110 can be formed from any suitable material. For example, housing 110 can be formed from metal, plastic, or composite materials, or any combination of these materials. Aspects of housing 110 can be formed by combining sub-components of housing 110, including walls, formed from these materials using any suitable joining method, including adhesives, fasteners, or welding.

As shown in FIGS. 1 and 7, housing 110 includes a door 120. Door 120 forms at least part of one of the exterior surfaces of housing 110 and allows access to products 102 in interior 112. For example, as shown in FIG. 1, door 120 may be configured to swing open and closed to allow access to interior 112. In the aspect shown in FIG. 1, door 120 swings open towards the right side of housing 110, but swinging aspects of door 120 can be configured to open in any desired direction. For example, with respect to FIG. 1, door 120 could instead swing towards the left, top, or bottom of housing 110. Other aspects of door 120 can open using different opening techniques than the swinging as shown in FIG. 1. For example, door 120 may slide with respect to housing 110. As shown in FIG. 1, door 120 comprises a portion of an exterior surface of housing 110 (i.e., the front of housing 110). In other aspects, door 120 can comprise an entire external surface of housing 110. As shown in FIG. 1, door 120 can be formed at least partially from a transparent material that allows interior 112 and products 102 to be seen from the exterior of housing 110. Aspects of door 120 can include a door frame 121 that defines the perimeter of door 120. In aspects of door 120 that have a transparent portion, door frame 121 can be formed form an opaque material, such as metal or plastic, and can frame the transparent portion of door 120.

Door 120 can include a lock 150 that can be selectively unlocked to regulate access to interior 112. Lock 150 can be any suitable type of lock that can releasably secure door 120 to housing 110. For example, lock 150 can comprise a linear actuator that advances and retracts a locking bar or latch into housing 110 to secure door 120 to housing 110. This relationship can be reversed, and the lock bar or latch can extend from housing 110 into door 120. In other aspects, lock 150 can be an electromagnet disposed in either housing 110 or door 120 that can be activated to magnetically secure door 120 to housing 110. As explained below, aspects of lock 150 are electronically controlled to lock and unlock door 120 when needed.

Aspects of housing 110 can include a cooling system 130. Cooling system 130 can maintain a desired temperature of interior 112. For example, cooling system 130 may maintain interior 112 at between minus 5 degrees Fahrenheit to and 5 degrees Fahrenheit or between 35 degrees Fahrenheit and 45 degrees Fahrenheit. Cooling system 130 can be any suitable cooling system. For example, cooling system 130 can be an evaporator-condenser type system that circulates refrigerant between an evaporator, a compressor, and a condenser to cool air passing over the evaporator to cool air circulating in interior 112. Aspects of housing 110 that include cooling system 130 can include suitable insulation to improve cooling performance and reduce energy required to maintain a desired temperature of interior 112.

Figure 2:
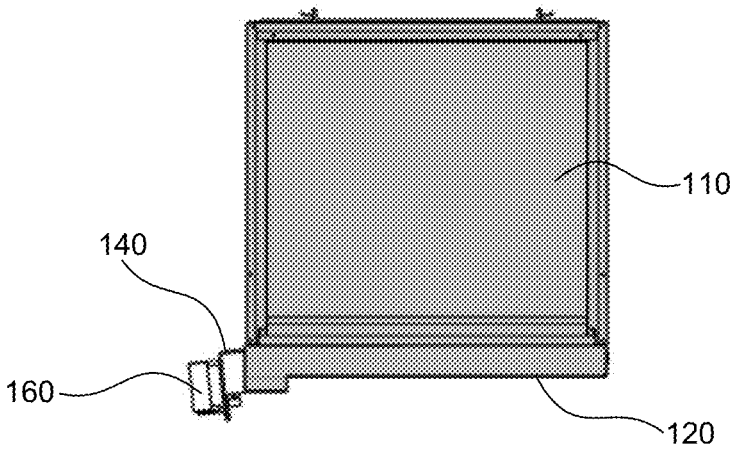
FIG. 2 is a top view of a self-service kiosk in a first configuration according to aspects of the present disclosure.
Figure 3:
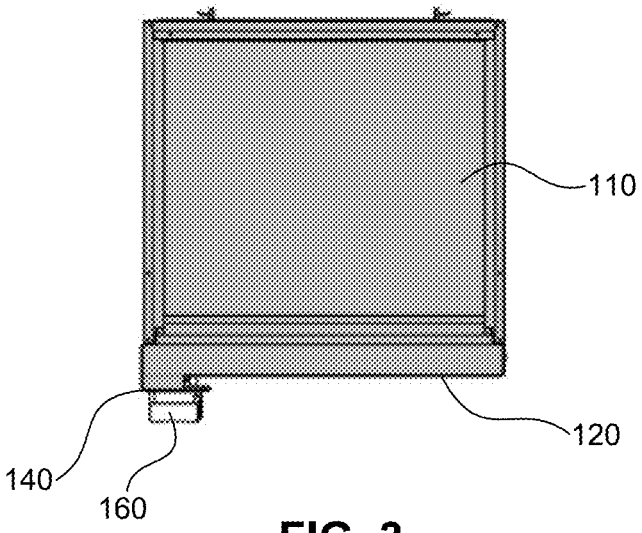
FIG. 3 is a top view of a self-service kiosk in a second configuration according to aspects of the present disclosure.
Figure 4:
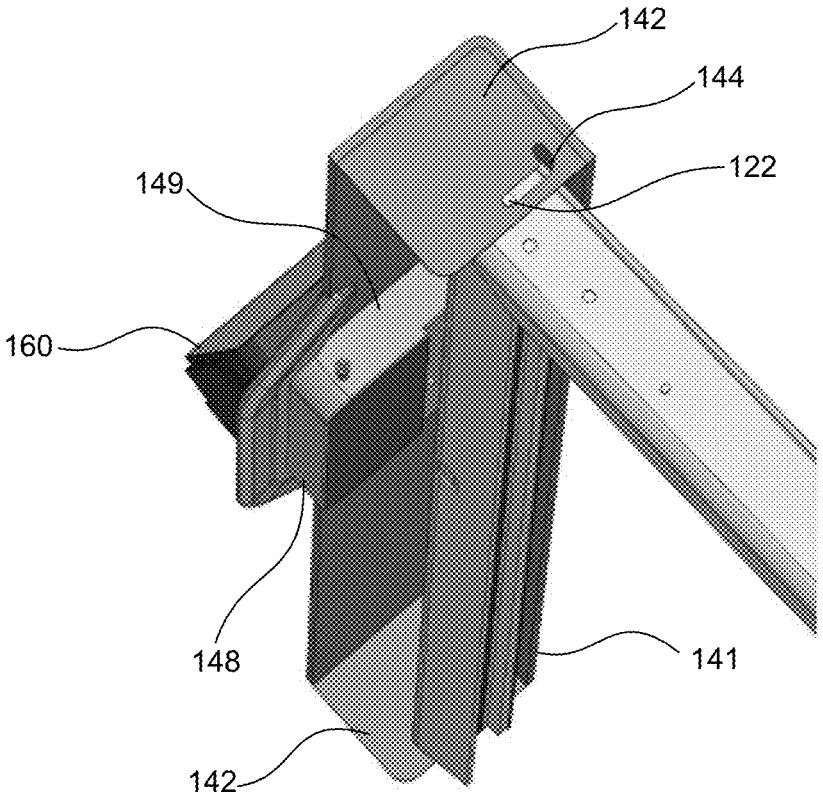
FIG. 4 is a perspective view of a bar of a self-serve kiosk according to aspects of the present disclosure.

As shown in FIGS. 1-4 and 7, bar 140 is disposed on an external surface of door 120. Bar 140 serves at least two functions in self-serve kiosk 100. First, it acts as handle that a user can use to open door 120. Second, it serves as a support for a user interface 160 and related components, including in some aspects a controller 170. As shown in FIG. 4, in an aspect bar 140 is formed as a rectangular prism and comprises a rectangular base member 141 with two of its long sides left open. That is, base member 141 comprises two rectangular sheets that are joined to each other along corresponding long edges. A pair of end members 142 are joined to either end of base member 141 to partially enclose bar 140. Bar 140 can be formed from any suitable material, including, for example, metal, plastic, or composite, materials. Bar 140 may be formed from a single sheet of material by, for example, bending, or can be formed from different subcomponents that are joined by any suitable method, such as adhesives, fasteners, or welding.

As shown in FIGS. 1-3, bar 140 is disposed on an external surface of door 120. In these aspects, bar 140 is positioned on the left side of door 120 because door 120 hinges to open towards the right of FIG. 1. In some aspects as shown in FIG. 1, bar 140 is disposed at or near an edge of door 120. In other aspects of door 120 that hinge in a different direction from the aspect shown in FIG. 1, or in aspects of door 120 that slide, for example, bar 140 may be disposed on a different portion of door 120. For example, in an aspect of door 120 that hinges open downwards, bar 140 may be positioned at or near the top of door 120. In aspects of door 120 with transparent portions, bar 140 may be positioned to minimize any shadowing or covering of the transparent portion of door 120. For example, as shown in FIG. 1, bar 140 may be positioned entirely over an opaque portion of door 120 (here, door frame 121). This improves visibility of products 102 through door 120. As shown in FIG. 4, the open construction of bar 140 allows a user to grasp bar 140 to pull door 120 open. Further details regarding the handle functionality of door 120 are discussed below.

As best shown in FIG. 7, in an aspect bar 140 can be longer than the full length of door 120, which as described below enables bar 140 to be pivotally attached to the exterior longitudinal surfaces of door 120. In other aspects, bar 140 may only extend partially along the relevant dimension door 120. For example, in aspects like those of FIG. 1 where bar 140 is mounted vertically, bar 140 may only extend part of the way vertically along door 120.

Bar 140 is rotatably or pivotally attached to door 120 such that bar 140 can rotate between a handle position as shown in FIG. 3 and an access position as shown in FIG. 4. The handle position is the standard operating position of bar 140 and allows a user to interface with bar 140 during the purchase process. Specifically, this position allows a user to, among other functions, use bar 140 to open door 120. The access position rotates bar 140 away (i.e., outwards) from a plane defined by a front exterior surface of the door 120 and allows access to the rear of bar 140 for installation and maintenance of user interface 160 and controller 170. In an aspect, rotation of bar 140 moves bar 140 further away from interior 112 of housing 110. The rotation of bar 140 can be in any desired orientation. For example, rotation of bar 140 may be along the vertical axis as shown in FIGS. 1, 3, and 4. However, rotation can occur on any other desired access depending on the orientation of the pivot connection between bar 140 and door 120. In an aspect as shown in FIG. 4, the rotating connection between bar 140 and door 120 is accomplished by fitting a pivot pin 122 fixed to door 120 that is fitted into a track 144 in bar 140. There may be a one pair of pivot pin 122 and track 144 for each end of bar 140. In this way, pivot pin 122 guides the movement of bar 140 as it slides along the path defined by track 144. Track 144 may define any suitable path. For example, track 144 may be formed to create an L-shaped path as shown in FIG. 4. In other aspects as shown in FIG. 7, bar 140 may be connected to door 120 by a hinge connection 146 at either end of bar 140. In any aspect, bar 140 can be secured to door 120 to prevent unauthorized rotation. For example, bar 140 may be secured by fasteners to door 120. In some aspects, one or more of these fasteners may only be accessible when door 120 is unlocked. This, in turn, provides additional security for any components mounted to bar 140 because the mounted components can be configured such that they can only be removed when bar 140 is in the access position.

Figure 5:
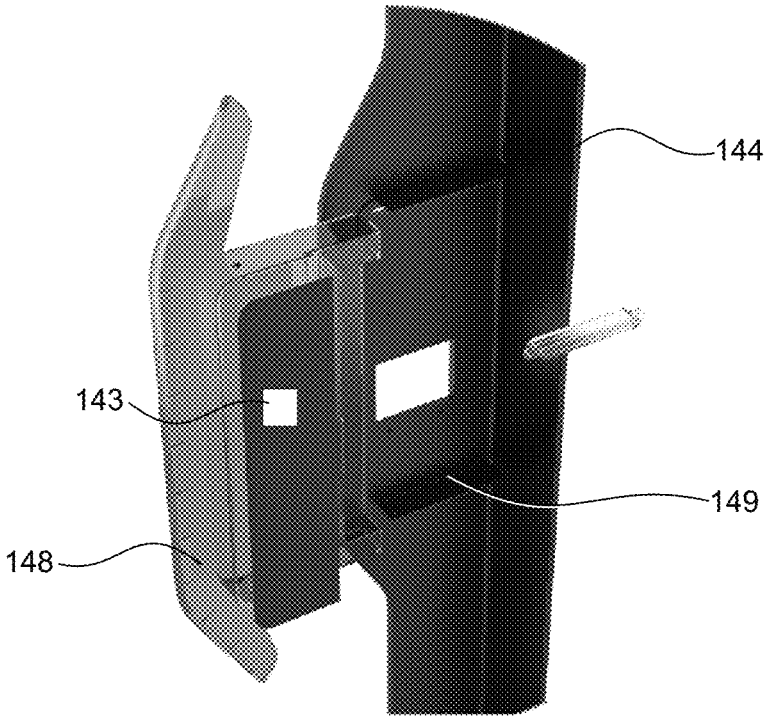
FIG. 5 is a detail view of a bar showing a user interface housing of a self-serve kiosk according to aspects of the present disclosure.
Figure 6:
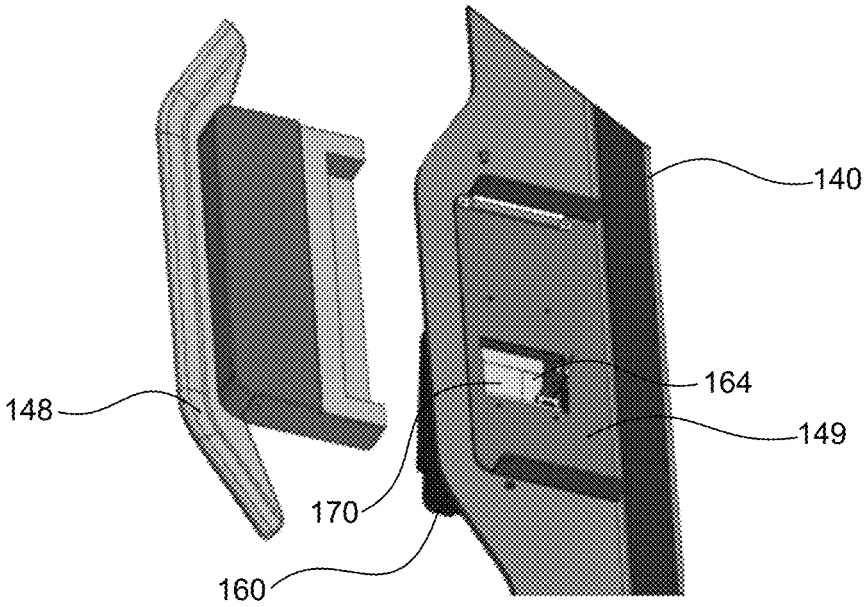
FIG. 6 is a detail view of a bar showing a controller housing of a self-serve kiosk according to aspects of the present disclosure.

As shown in FIGS. 4-6, a handle 148 is included in bar 140. Handle 148 is configured to be grasped by a user to assist in opening door 120. As shown in FIGS. 4-6, handle 148 can be disposed on the rearward surface of bar 140 and can extend laterally away from bar 140 to present a grasping surface for a user to grasp that is clear of bar 140. Handle 148 can be mounted to bar 140 by sliding handle 148 into a handle bracket 149 that is disposed on the rearward surface of bar 140. Handle 148 can be secured to bar 140 by any suitable method, such as mechanical fasteners or a snap fit. Handle 148 can be constructed from any suitable material, such as metals, plastics, or composites. In some aspects, handle 148 is positioned adjacent to user interface 160 and can also serve to hide cables and related connectors that extend from the rear of user interface 160.

In some aspects, handle 148 is constructed from a translucent (i.e., not fully opaque) plastic material. In these aspects, a light 143 can be mounted in or near handle 148 to illuminate the translucent material of handle 148 to provide an improved user experience by illuminating handle 148. In some aspects, this illumination may cause handle 148 to be back-lit. In some aspects, light 143 is configured to illuminate both handle 148 and interior space 112, either through a suitable opening in door 120 or through transparent material disposed on door 120. In other aspects, light 143 is only configured to illuminate handle 148. In some aspects, light 143 can display different colors, which can serve to indicate a status of self-serve kiosk 100. For example, light 143 may illuminate handle 148 in one color (e.g., green) when a payment has been received, and may illuminate a second color (e.g., yellow) when self-serve kiosk 100 is in a standby mode. Light 143 can also be configured to illuminate handle 148 in various patterns to improve the aesthetic appearance of self-serve kiosk 100. Light 143 may be any suitable light, including, for example, a light emitting diode.

As shown in FIGS. 1 and 4, bar 140 also includes a user interface 160 disposed on an exterior surface of bar 140. User interface 160 allows a user to interact with self-service kiosk 100 to, for example, purchase a product. In aspects, user interface 160 can include a touchscreen display that can display information and receive user input. In some aspects, user interface includes only a single touchscreen as the sole input device located on bar 140 (and/or self-serve kiosk 100). User interface 160 can also include payment receptacles such as, for example, a credit card slot 162 with a corresponding credit card reader. In aspects, user interface 160 can include a wireless transceiver 164 that can transmit and receive data using a suitable transmission method, such as existing cellular data networks, Bluetooth, WIFI, NFC, or any combination of wireless transmission methods. In these aspects, user interface 160 can also receive purchase information wirelessly from a user via communication between wireless transceiver 164 and, for example, an application running on user's mobile device. The physical components of user interface 160 can be mounted to bar 140 through any suitable method, including mechanical fastening.

Controller 170 is also disposed in housing 110. In some aspects as shown in FIG. 7, controller 170 may be disposed in housing 110 (e.g., near cooling system 130). In other aspects as shown in FIG. 6, controller 170 can be co-located with user interface 160. Controller 170 can also constitute multiple components (e.g., processors, computer memory) distributed in several different locations in housing 110. In some aspects, part or all of controller 170 can be located remotely from housing 110, for example in a remote server that can be accessed via data transmission. Controller 170 controls various functions of self-serve kiosk 100, including, for example, user interface 160, the self-serve functionality discussed below, locking and unlocking lock 150 to allow door 120 to be opened, and light 143 that illuminates handle 148. In aspects, controller 170 includes one or more processes operatively connected to computer memory that stores operating instructions for controller 170.

Bar 140 can be integrated into a new self-serve kiosk 100 in the initial design phase and can provide the improved maintenance access for user interface 160 and other components (e.g., controller 170) discussed above. Locating these components in bar 140 can also improve ease of conversion of existing product coolers into self-serve kiosk 100 because most of the additional components needed for the conversion are located in a single structure (bar 140) that is fixed to an exterior of door 120. Attaching bar 140 requires minimal, if any, structural changes to the interior of the existing product cooler, and only minor structural changes to door 120. This modification also reduces or eliminates the need to widen housing 110 to accommodate user interface 160 while still placing user interface 160 in a suitable position for user access. Any additional sensors that are needed to implement the self-serve functionality (discussed below) can be added interior 112 of the existing product cooler with relatively minimal structural changes. In some aspects, as discussed below, the additional sensors can be integrated bar 140, further reducing the need to modify the existing cooler. Thus, conversion of existing product coolers to self-serve kiosk 100 is improved by aspects of the present disclosure.

Self-serve kiosk 100 operates autonomously, or without any need for a salesperson to be physically present, during the purchase process. In aspects, a self-serve operation of self-serve kiosk 100 begins with a user interacting with user interface 160 to input purchase information. For example, user interface 160 may prompt a user to insert their credit card. In another example, user interface 160 may prompt a user to input user account information that can be used to retrieve a preexisting user account that is linked to a payment method. After controller 170 verifies the payment information received by user interface 160, controller 170 unlocks lock 150 to allow door 120 to be opened by the user. The user than selects one or more products 102 for purchase and removes them from interior 112. In some aspects, an inventory sensor 172 operatively connected to controller 170 detects which products 102 have been removed from interior 112, and controller 170 then charges the corresponding amount to the user using the received payment information. In some aspects, inventory sensor 172 is one or more cameras that records the position of products 102 in interior 112. When one or more products 102 are removed, their removal is detected by sensor 172 and processed by controller 170. In other aspects, inventory sensor 172 can include wireless sensors that detect the presence of products 102 through, for example, NFC transmission from an NFC tag disposed on products 102. The removal of one or more products 102 is detected by these sensors 172 and, in turn, controller 170 for charging to the user. In other aspects sensor 172 can be a product scanner disposed on bar 140 (e.g., near user interface 160). In these aspects, after selecting one or more products 102, the user scans them with sensor 172 to identify which products 102 are being removed. Controller 170 then charges the user as discussed above.

It is to be appreciated that the Detailed Description section, and not the Summary and Abstract sections, is intended to be used to interpret the claims. The Summary and Abstract sections may set forth one or more but not all exemplary aspects of the present invention(s) as contemplated by the inventors, and thus, are not intended to limit the present invention(s) and the appended claims in any way.

The foregoing description of the specific aspects will so fully reveal the general nature of the invention(s) that others can, by applying knowledge within the skill of the art, readily modify or adapt for various applications such specific aspects, without undue experimentation, and without departing from the general concept of the present invention(s). Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary aspects, but should be defined only in accordance with the following claims and their equivalents.

What is claimed is:

1. A product cooler for storing products for sale, the product cooler comprising:

a housing comprising a door that is configured to provide access to an interior of the housing;

a lock that is configured to lock the door to restrict access to the interior of the housing;

a bar comprising a base member and an end member disposed at an end of the base member and pivotally connected to an exterior of the door such that the bar can rotate with respect to the door, wherein the bar has a longitudinal length that is longer than a longitudinal length of the door, and wherein the end member is attached to a portion of a frame of the door;

a controller configured to lock and unlock the lock; and a user interface mounted to the bar.

2. The product cooler of claim 1, wherein the bar comprises a second end member disposed at an opposite end of the bar, and wherein both of the end members are pivotably connected to the door.

3. The product cooler of claim 2, wherein a pivot pin is disposed on an exterior of the door, wherein at least one of the end members comprises a track configured to receive the pivot pin, and wherein the bar is configured to rotate relative to the door about the pivot pin as the pivot pin travels along a path dictated by a shape of the track.

4. The product cooler of claim 3, wherein the bar is configured to rotate away from the door in a clockwise direction relative to the door.

5. The product cooler of claim 4, wherein the bar is configured to rotate away from the door in a counterclockwise direction relative to the door.

6. The product cooler of claim 5, further comprising a handle for opening the door, wherein the handle is configured slide between the door and the bar and is further configured to mount to the bar.

7. The product cooler of claim 6, further comprising a bracket that is configured to slidably receive the handle and that is configured to fix the handle to the bar via fasteners.

8. The product cooler of claim 6, wherein the handle comprises a translucent material.

9. The product cooler of claim 8, wherein the bar comprises a light configured to illuminate the translucent material of the handle.

10. The product cooler of claim 9, wherein the controller is disposed in the bar.

11. The product cooler of claim 9, wherein the handle is illuminated via a light dedicated to the handle.

12. A self-serve kiosk comprising:

a housing comprising a door that is configured to provide access to an interior of the housing;

shelves disposed in the interior of the housing configured to receive products to be dispensed;

a lock that is configured to lock the door to restrict access to the interior of the housing;

a bar that is pivotably connected to the door, wherein the bar comprises a track and the door comprises a pin that extends through the track, and wherein bar is configured to rotate relative to the door along a path dictated by a shape of the track;

a handle disposed on the bar and configured to be grasped by a user; and a controller is configured to lock and unlock the lock, wherein movement of the bar is configured to allow access to the controller for maintenance.

13. The self-serve kiosk of claim 12, wherein the bar has a longitudinal length that is longer than a longitudinal length of the door.

14. The self-serve kiosk of claim 12, wherein the bar is configured to rotate in a clockwise direction relative to the door.

15. The self-serve kiosk of claim 12, wherein the bar is configured to rotate in a counter-clockwise direction relative to the door.

16. The self-serve kiosk of claim 12, wherein the handle is configured slide between the door and the handle is further configured to mount to the bar.

17. The self-serve kiosk of claim 16, wherein the handle comprises a translucent material, and wherein the bar comprises a light configured to illuminate the translucent material of the handle.

* * * * *